United States Patent [19]

DeMotte

[11] Patent Number: 4,627,845

[45] Date of Patent: Dec. 9, 1986

[54] EYES-BATHING FAUCET-MATEABLE STRUCTURE

[76] Inventor: Frank E. DeMotte, MR-18 Blue Mill Rd., Morristown, N.J. 07960

[21] Appl. No.: 678,052

[22] Filed: Dec. 4, 1984

[51] Int. Cl.[4] ..... A61H 35/00

[52] U.S. Cl. ..... 604/295; 4/620; 4/624; 239/31; 239/587

[58] Field of Search ..... 604/294–301, 604/43, 150, 94, 150, 302; 4/620, 624; 239/31, 587

[56] References Cited

U.S. PATENT DOCUMENTS

| | | | |
|---|---|---|---|
| 143,928 | 10/1873 | Potter | 604/301 |
| 676,379 | 6/1901 | Young | 604/295 |
| 2,910,064 | 10/1959 | Brangaitis | 604/301 |
| 3,424,156 | 1/1969 | Smith | 604/150 |
| 3,809,315 | 5/1974 | Wright | 4/620 |
| 3,925,829 | 12/1975 | Bost | 4/620 |
| 4,493,119 | 1/1985 | Baumann | 604/296 |

FOREIGN PATENT DOCUMENTS

| | | | |
|---|---|---|---|
| 0809270 | 4/1937 | France | 239/587 |

*Primary Examiner*—C. Fred Rosenbaum
*Assistant Examiner*—Karen L. Kaechele
*Attorney, Agent, or Firm*—William T. Hough

[57] ABSTRACT

This invention is directed to a device which in a preferred embodiment thereof includes a pair of spaced-apart eye-bathable water-outlets adjustable of both the distance spaced-apart and the positioning between vertical and horizontal of the pair, with the water-outlets being of diverging conical shape having outer circumscribing walls thereof of substantially oval shape, water-conducting conduit structure, being of polyvinyl chloride plastic to a major extent, and the water-inlet thereof being mateable on any one of faucets of diverse shapes and structures by virtue of the water-inlet end being or including a flexible multi-purpose mating structure.

5 Claims, 5 Drawing Figures

EYES-BATHING FAUCET-MATEABLE STRUCTURE

This invention is directed to a faucet-mateable structure for washing-out the eyes by water-bathing thereof.

BACKGROUND

Prior to the present invention, there has not existed any suitable device for use by either an opthomologist or patients or non-patients for easy and safe and tidy bathing the eye(s) of the person. The bathing of the eye(s) is necessary and required under a variety of different circumstances. One, for example, is when certain tear duct(s) and/or tear gland(s)—known as lachrymal glands, either or both under-function or mal-function, or are susceptable abnormally to become clogged or inflamed, it is important for such person to periodically wash out the eye(s) with warm or hot water under sanitary conditions in order to cleanse the eye(s) of crystals, thickened oil-secretions, as well as dust or other particles from the air trapped by the eyelashes and/or adhered to the eyelashes in-whole or in-part. Also, whenever an eyelash or other foreign particle or foreign-matter is in the eye and/or under the eyelid, causing discomfort and/or irritation to the tissues of the eye and/or eyelid, the washing-out of the eye as noted-above can be desirable or required. Accordingly, for numerous persons, such eye conditions occur frequently unless prophylactically the eyes are cared for typically by the washing-out of the eye(s), and there has existed a great need for the present invention, suitable for use at home or in the office of a doctor equally well.

THE OBJECTS

Accordingly, objects of the invention include the overcoming of difficulties and problems hetertofore faced as noted-above.

Another particular object is to obtain an eye-bathing device adapted for mating with a faucet, for washing-out eye(s).

Another object is to provide an eye-flushing device having one or a pair of water-outlets of substantially oval shape.

Another object is to provide and obtain a flushing-mechanism providing for continuous flow of water of predetermined substantially unchanging temperature exiting continuously from the water-outlet(s).

Another object is to obtain such a device having a shape and spacing-apart of a predetermined distance as to be adaptable to the distance between eyes of an average person, for the concurrent or simultaneous washing of both eyes therewith.

Another object is to obtain such device with the water-outlet(s) thereof for the continuously-flowing mechanism, being of diverging shapes such as conical such that rate and pressure of flow at the outlet(s) are reduced on an increased cross-sectional area basis as compared to rate and pressure of flow from a faucet onto which an inlet-end thereof is mated, during flow of water through conduit space thereof; accordingly, any flared-shape widening of area of application to the eye for each water outlet during washing-out of the eye(s) reduces pressure at the outlets.

Another object is to obtain an eyes-washing device in which the one or more water-outlets are positionable and repositionable adjustably angularly from an upright or vertical position to a horizontal position or to any point therebetween as desired or required by the person using the device for washing-out the eye(s).

Another object is to obtain an eye-washing device easily susceptable to easy maintenance in a clean and sanitary state.

Another object is to obtain an eye-washing device having paired spaced-apart water-outlets adjustable of distance therebetween to greater or lesser distances as desired or necessary by the user thereof.

Another object is to obtain an eye-washing device of a composition not readily conductable of heat, and of durable and strong physical characteristics.

Another object is to obtain such a device susceptable and structured to be optionally mated with any one of diversely shaped and different types of faucets.

SUMMARY OF THE INVENTION

One or more of the above objects are obtained by one or more embodiments of the invention, as follow. In one embodiment, there is provided a tubular structure having a water-inlet end and having one or more water-outlet ends interconnected to the water-inlet end by tubular space, providing for water flow from the inlet end to and out-of the water-outlet ends. The water-inlet end includes a mechanism for mating with a water-faucet outlet structure, such that water from the faucet flows into the tubular space. The water-outlet ends are in this embodiment of a substantially oval cross-section shape in definition of the outlet-space thereof such that the substantially oval outlet-circumscribing walls may be placed easily below the brow of a person into close proximity to the eyeball or pressed lightly and loosely against the skin above the cheek and below the eyebrow to facilitate ease and thoroughness of bathing of the eye(s). For this embodiment there are a number of preferred embodiments thereof, such as flared or conically-shaped water-outlets, and paired spaced-apart water-outlets, and for a device having paired water-outlets the structures thereof being separate and adjustable variably of spaced-apart distance therebetween, and the one or more water-outlet(s) being angularly adjustable to any desired position between upright and horizontal, and being of the preferred thermoplastic composition, preferably polyvinyl chloride plastic.

In a second distinct broad embodiment, a conduit structure has the above-noted water-inlet end and structure thereof, and has two of the above-noted water-outlet ends and structures thereof, interconnected by through-space passable of water from the inlet end to and out-of the outlet(s), the two water-outlets being a pair of spaced-apart outlets spaced-apart a predetermined distance such that they are substantially alignable with the paired eyes of an individual concurrently washing both eyes with water flowing from the outlet-spaces of the spaced-apart outlets of the pair. Likewise, for this embodiment, there are the above-noted preferred embodiments thereof.

THE FIGURES

FIG. 1 illustrates a typical preferred embodiment of the invention, shown in a front view thereof with the water-inlet and water-outlets all extending uprightly or vertically, illustrated in partial cut-away of the water-outlet ends and of the water-inlet and T-section and joining-portions thereof to the separate and pivotally and axially-slidably mounted water-outlet portions of the structure, such being a diagrammatic illustration not intended to be exactly to scale.

FIG. 2 illustrates a typical appearance of the water-outlets and outlet space thereof as viewed looking upwardly as taken along line 2—2 of FIG. 1 embodiment.

FIG. 3A and FIG. 3B each diagrammatically represent a side view of the embodiment of FIG. 1, the FIG. 3A being a view typically taken along line 3A—3A of FIG. 1, and FIG. 3B being a view at the same observation point but with the water-outlet ends being angularly adjusted to about a 45 degree angle as measured from a horizontal, showing the FIG. 3A position in phantom.

FIG. 4 illustrates a view substantially comparable to that of FIG. 1, but of an alternate embodiment in which the entire device is a single unitary molded structure, and is merely diagrammatic.

DETAILED DESCRIPTION

Figure 4:
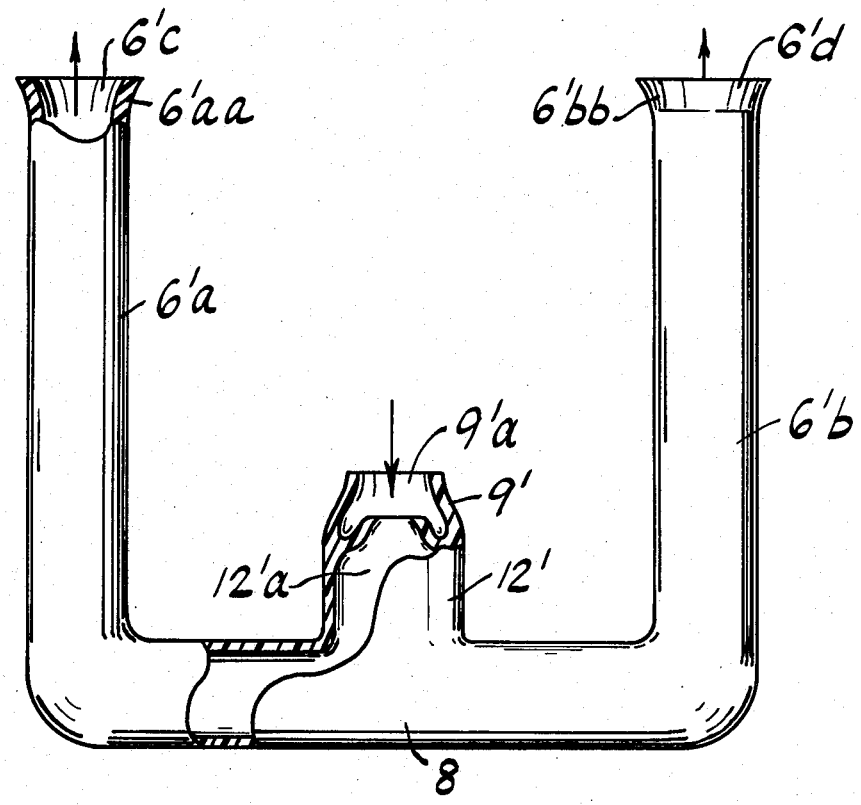

FIGS. 1, 2, 3A and 3B represent a common embodiment of the invention illustrated therein and accordingly all indicia shown correspond among these four figures. In FIG. 4, an alternate illustrated embodiment utilizes modified but related indicia that accordingly correspond to comparable parts or elements identified possibly previously in the embodiment of FIGS. 1, 2, 3A and 3B. Once a part has been identified or discussed, a corresponding part or element in a different figure will not be repeated, except for purposes of clarity and/or further discussion.

Figures 1, 2:
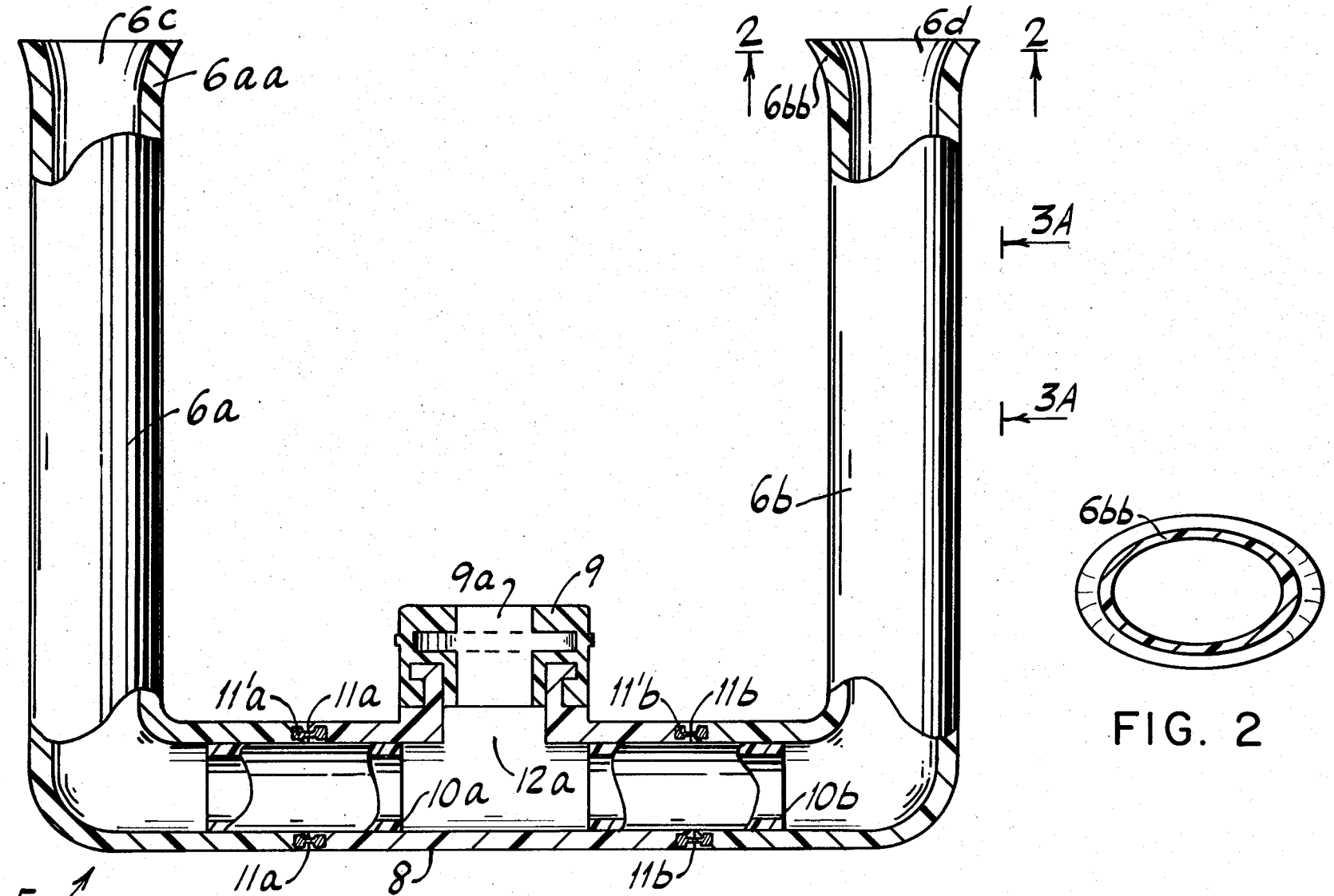
Figure 3A:
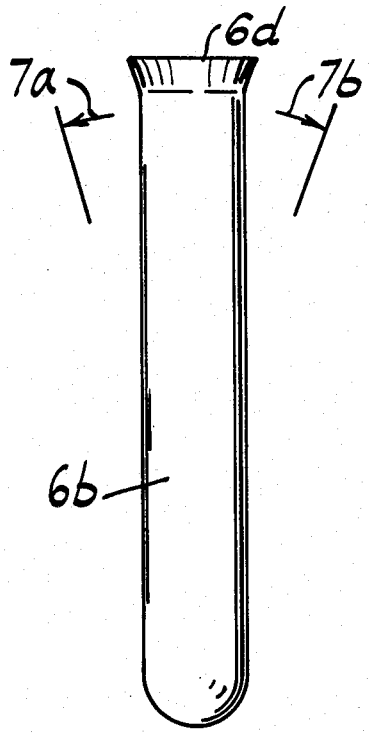
Figure 3B:
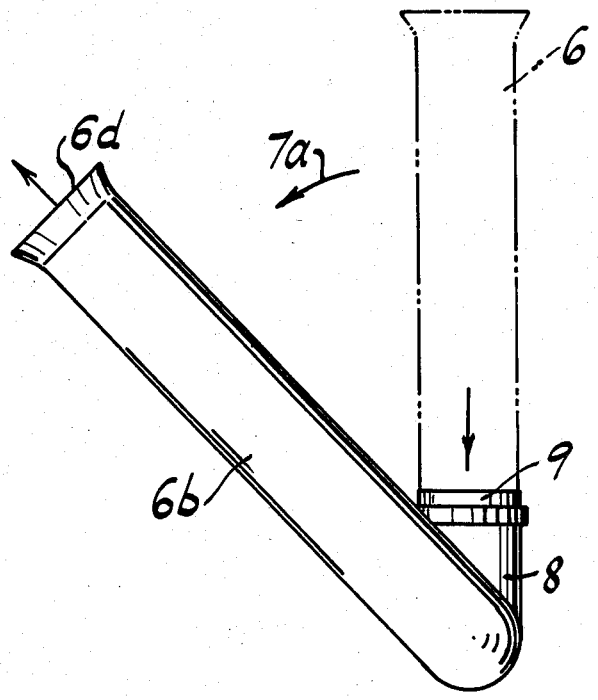

Accordingly in FIGS. 1, 2, 3A and 3B, the following observations can be made to the viewer, for that embodiment 5. The uprightly or vertically-positioned separate portions 6*a* and 6*b* respectively having water-outlet ends 6*aa* and 6*bb* respectively with their water-outlet spaces 6*c* and 6*d* respectively, have through-space therethrough continuous with through-space of the inverted-T member 8 and its inlet-port space 12*a* formed in the neck-structure (not numbered) that mounts the flexible faucet-mating structure 9 that has its inlet-port space 9*a*. Space 12*a* is continuous with inlet-port space 9*a*. Inside the horizontal portion of water-outlet end 6*a* is positioned with a slidable friction-fit an inner tubular element 10*a* that similarly extends into the horizontal portion of inverted-T member 8, providing axial sliding movement outwardly from the T-member when slight pressure is applied laterally while moving the end 6*a* angularly backwardly and forwardly in motions 7*a* and 7*b*. Thereby, the distance laterally outwardly from the other end 6*b* may be increased, or moved back to the illustrated minimal distance. Likewise the end 6*b* is frictionally mounted on tubular element 10*b* that also extends into the tubular space by friction fit (or fused thereto) of the inverted-T member 8, and is in like manner movable laterally to alter distance from end 6*a*. It should be noted that substantially equivalent benefits are obtainable when merely one of the ends 6*a* and 6*b* is movable laterally away from the other, with the remaining one thereof being fused or non-slidable laterally. Additionally, however, as noted above, these joint connections above-described provide the benefit of permitting the ends 6*a* and 6*b* to be positioned as desired by the user to different and/or desired angles such as either 7*a* or 7*b*, to typically a position such as shown in FIG. 3B. Optional but preferred gasket elements 11'a and 11'b provide for improved pivotal action, as well as for locking-in the joints to one-another, requiring greater pressure laterally to initially unlock to move an end 6*a* or 6*b* laterally, at the joints 11*a* and 11*b* respectively. In the uprightly-positioned neck structure of the inverted-T element 8, forming inlet-space 12*a*, there is mounted the flexible faucet-mating structure 9 having its water-inlet port 9*a*, which structure 9 is symbolic of conventional commercially-available or other desired faucet mount that is designed/shaped and/or semi-rigid or flexible structure such that it is mountable on any one of a variety of conventional faucet outlet structures.

It should be noted that while this invention as disclosed illustrates merely a single inlet structure for the water, being illustrated for the typical modern situation and equipement in which hot and cold water feed outwardly from a common faucet structure, i.e. a single faucet with separate hot and cold levers, or with a single lever controlling and providing for adjustment of relative amounts of flow from hot and cold water lines, it is within the scope of the invention to have the illustrated structures modified to include spaced-apart water-inlet ends feeding commonly to a T-member that feeds the water-outlet ends. Such may also be provided as a separate accessory, for connecting to separate faucets and with an outlet connectable to the member 9 or directly to the neck-structure of the inverted-T member 8.

FIG. 2 illustrates best the oval shapes characteristic of the water-outlet spaces(ports) 6*d* and 6*c* respectively, the view of FIG. 2 being specifically of the structure 6*bb* and space/port 6*d*. Significance and importance of this shape arises from the fact that a substantially circular outlet-structure will not normally fit well into space between a person's cheek bone and the bone of the eyebrow, making it difficult to get such a round (circular) structure into a proper washing position. On the other hand, an oval or other irregularly-shaped(substantialy oval shaped)outlet-structure is easily positioned close to the eye comfortably, for greater ease and improved efficiency in washing-out the eye by bathing with water from the outlet ports(spaces).

FIG. 3A in its side view, illustrates that the arms/outlet end structure(s) 6*a* and 6*b* may be pivotally moved in alternately directions 7*a* or 7*b*, and the friction fit previously described will result in the end structures 6*a* and/or 6*b* staying wherever positioned until repositioned by pivotal force.

Accordingly, FIG. 3B illustrates an angularly repositioned state in which both end portions/structures 6*a* and 6*b* have been repositioned from the upright position shown by phantom-image 6 to that shown for end structure 6*b*, the end structure 6*a* being behind end structure 6*b* in this FIG. 3B side view and therefor the end structure 6*a* being present but not visible in FIG. 3B.

FIG. 4 illustrates an alternate embodiment described above, in which typically it would be molded from a thermoplastic such as polyvinyl chloride plastic, and the upright portions of the outlet structures bent to that position by heating and bending subsequent to the molding. In this embodiment, the faucet mounting structure is of the same substantially flexible structure as the remainder of the device. Thus the T-neck structure 8 includes neck structure 12' which is continuous with the faucet-mounting structure 9' defining its inlet space and port 9'a.

It is important to point-out that an embodiment such as FIG. 4 embodiment may, however, have an inlet-structure at its neck of the T-shaped structure(inverted) of FIG. 1, and likewise may utilize a separate mateable flexable mounting structure 9 thereon. An advantage to the embodiment of FIG. 4 is that there are no cracks or creases or joints into which grease or grime or dirt or other matter may collect that by collection could produce conditions susceptable of bacteria growth, causing an unsanitary condition. Accordingly, while the embodiment of FIGS. 1, 2, 3A and 3B have various advantages described above, such embodiment will require also greater care in disassemblying and cleaning periodically, preferably, to prevent the possibility of unsanitary conditions.

Each of FIGS. 3B and 4 illustrate with arrows the directions of flow of water therethrough when mated with a faucet(not shown).

Whereas in the embodiment of FIG. 4 the faucet-making structure is integral with the other structure of the device, a thermoplatic such as polypropylene may optimally be utilized since such is flexible and increases in strength each time flexed, providing thus good and appropriate flexible and sturdy faucet mounting structure.

It is within the scope of the invention to make variations and modifications, and substitutions of equivalents within the skill of an ordinary artisan.

With regard to prior art, no relevant art is known. However, U.S. Pat. No. 3,925,829 to Bost discloses a water-fountain having a circular single water-outlet structure and port thereof, such not being for nor suggesting a faucet-mounting and negatively teaching solely a single water-outlet and that outlet being negatively circular in the cross-sectional space of its outlet port. The device of U.S. Pat. No. 2,910,064 to Brangaitis clearly is not of a type that is readily-portable and does not provide nor suggest a device that may be intermittently attached and detached as a mode of ordinary usage-practice, and does not disclose paired outlets, negatively disclosing solely one which is apparently of circular shape in the cross-section of space of outlet port of eye piece 30, and not recognizing the benefits to be achieved by non-circular outlet port. U.S. Pat. No. 143,928 to Potter likewise has no provisions for and no suggestion of use with or on a faucet, as well as negatively teaching solely a single water-outlet and having negatively solely a circular outlet port-space for small vessel C. None of the objects and embodiments of Applicant's invention are disclosed nor made obvious by any one or more of such non-teaching references.

With regard to Applicant's water-outlets of diverging or flaring conical shape, such serves to reduce pressure and to widen the area of surface-contact of the eye with the water being flowed through the outlet port, pressure reduction being of particular importance where as here the present invention utilizes water from a faucet source where pressure can be normally or accidentally high or elevated, and/or where exact adjustment of pressure by some faucets is difficult or impossible.

I claim:

1. An eye-bathing device for mating with a faucet, comprising in combination: portable tubular structure separate from non-portable water faucet structure, and having a water-inlet end and having water-outlet ends interconnected by tubular through space therebetween adapted for continuous flow of water into and from said water-inlet end to and out-of said water-outlet ends said tubular through space including means for slidable adjustment to lesser or greater distances of space between said water-outlet ends and said water-inlet end comprising a water-faucet flexible-attaching means adapted for detachably intermittently mounting and mating said water-inlet end on a rigid spigot-outlet structure of a conventional water-faucet for continuous passage of water from the conventional water-faucet through the water-inlet end into said tubular space, and said water-outlet ends being substantially oval in shape of circumscribing walls of outlet space of the water-outlet ends and being of a predetermined size such that the water-outlet ends are comfortably substantially fitable against or adjacent the eyes of a person while bathing water is continuously exiting the water-outlet ends, said water-outlet ends having circumscribing walls substantially flared, and there being two of said water-outlet ends spaced-apart a predetermined distance such that the two spaced-apart water-outlets are substantially alignable with paired eyes of an individual concurrently washing both eyes with water continuously flowing from the two spaced-apart water-outlet ends, and the water-faucet attaching means including alternate-faucet-attaching structure of flexible composition adapted to be mateable on faucet structures of the different conventional shapes and structures.

2. An eye-bathing device of claim 1, in which said tubular structure comprises a thermoplastic composition.

3. An eye-bathing device of claim 2, in which said tubular structure comprises a major portion thereof being polyvinyl chloride plastic.

4. An eye-bathing device of claim 1, including pivot means positioned in juxtaposition to and substantially between the two spaced-apart water-outlet ends, for adjusting angularly said water-outlet ends relative to said water-inlet end to any desired position between vertical or upright position and horizontal position.

5. An eye-bathing device for mating with a faucet, comprising in combination portable tubular structure having a water-inlet end and having at-least two water-outlet ends interconnected by a tubular through space therebetween, said at-least two water outlet ends being angularly disposed with regard to said water inlet end, said water-inlet end comprising a water-faucet flexible-attaching meams detachably intermittently mounting and mating said water-inlet end on a rigid spigot-outlet structure of a conventional water-faucet, said water-outlet ends each being substantially oval in shape with circumscribing walls defining outlet space of the water-outlet end and being of a predetermined size such that the water-outlet end is comfortably sustantially fitable against or adjacent an eye of a person while water is continuously exiting the water-outlet ends, said tubular structure including adjustment means located in said tubular through space between said water-inlet end and at least one of said water outlet ends providing adjustment of said water-outlet end to the eyes of a person, said adjustment means comprising at-least one short tubular element frictionally fixed inside said tubular through space between said water-inlet end and at-least one of said water outlet ends providing both axial extension and rotational movement of said water-outlet end relative to said water-inlet end.

* * * * *